US008716640B2

(12) United States Patent
Baras et al.

(10) Patent No.: US 8,716,640 B2
(45) Date of Patent: May 6, 2014

(54) PILOTING DEVICE OF A MISSILE OR OF A PROJECTILE

(75) Inventors: Christian Baras, Saint Louis (FR); Denis Spitzer, Strasbourg (FR); Marc Comet, Huningue (FR); Fabrice Ciszek, Sierentz (FR); Frederic Sourgen, Mulhouse (FR)

(73) Assignee: Institut Franco-Allemand de Recherches de Saint-Louis, Saint-Louis (FR)

( * ) Notice: Subject to any disclaimer, the term of this patent is extended or adjusted under 35 U.S.C. 154(b) by 234 days.

(21) Appl. No.: 12/659,405

(22) Filed: Mar. 8, 2010

(65) Prior Publication Data

US 2011/0068220 A1 Mar. 24, 2011

(30) Foreign Application Priority Data

Mar. 6, 2009 (FR) ..... 09 01037

(51) Int. Cl.
*F42B 10/00* (2006.01)
*F42B 15/01* (2006.01)

(52) U.S. Cl.
USPC ..... 244/3.27

(58) Field of Classification Search
USPC ..... 244/3.21, 3.27, 46, 99.1
See application file for complete search history.

(56) References Cited

U.S. PATENT DOCUMENTS

| | | | | | |
|---|---|---|---|---|---|
| 2,681,619 | A * | 6/1954 | Chandler | 60/225 |
| 3,554,086 | A * | 1/1971 | Wills | 91/376 R |
| 4,624,424 | A * | 11/1986 | Pinson | 244/3.21 |
| 5,564,652 | A * | 10/1996 | Trimbath | 244/99.1 |
| 5,852,237 | A * | 12/1998 | Renshaw | 73/180 |
| 6,474,593 | B1 | 11/2002 | Lipeles et al. | |
| 6,530,305 | B1 * | 3/2003 | MacLeod et al. | 89/1.81 |
| 6,951,317 | B2 * | 10/2005 | Woessner et al. | 244/3.22 |
| 2005/0103925 | A1 | 5/2005 | Folsom et al. | |
| 2005/0103926 | A1 * | 5/2005 | Hawthorne | 244/3.27 |
| 2011/0186678 | A1 * | 8/2011 | Sankovic | 244/3.27 |

OTHER PUBLICATIONS

M. Comet et al., "Preparation of explosive nanoparticles in a porous chromium(III) oxide matrix: a first attempt to control the Reactivity of explosives," *Nanotechnology*, vol. 19, Jun. 3, 2008, IOP Publishing Ltd.

M. Comet et al., "Elaboration and Characterization of Manganese Oxide ($MnO_2$) Based 'Green' Nanothermites," *39th International Annual Conference of ICT*, Karlsruhe, Germany, Jun. 24-27, 2008, vol. 38-1 to vol. 38-8.

(Continued)

*Primary Examiner* — Valentina Xavier
(74) *Attorney, Agent, or Firm* — Oliff PLC

(57) ABSTRACT

The invention concerns the field of devices for improving the piloting of projectiles More specifically, the object of the invention is a piloting device for a missile or a projectile, for example, of small caliber, especially on the order of 40 mm, which has a lateral main surface with a nose at the level of one of its extremities, whereby said device includes at least one cavity consisting of a combustion chamber and filled, at least partially, by an explosive powder, and means of initiation of this explosive powder, and thereby the explosive powder includes nanothermites or gas-generating nanothermites.

11 Claims, 7 Drawing Sheets

(56) References Cited

OTHER PUBLICATIONS

Figure 1:
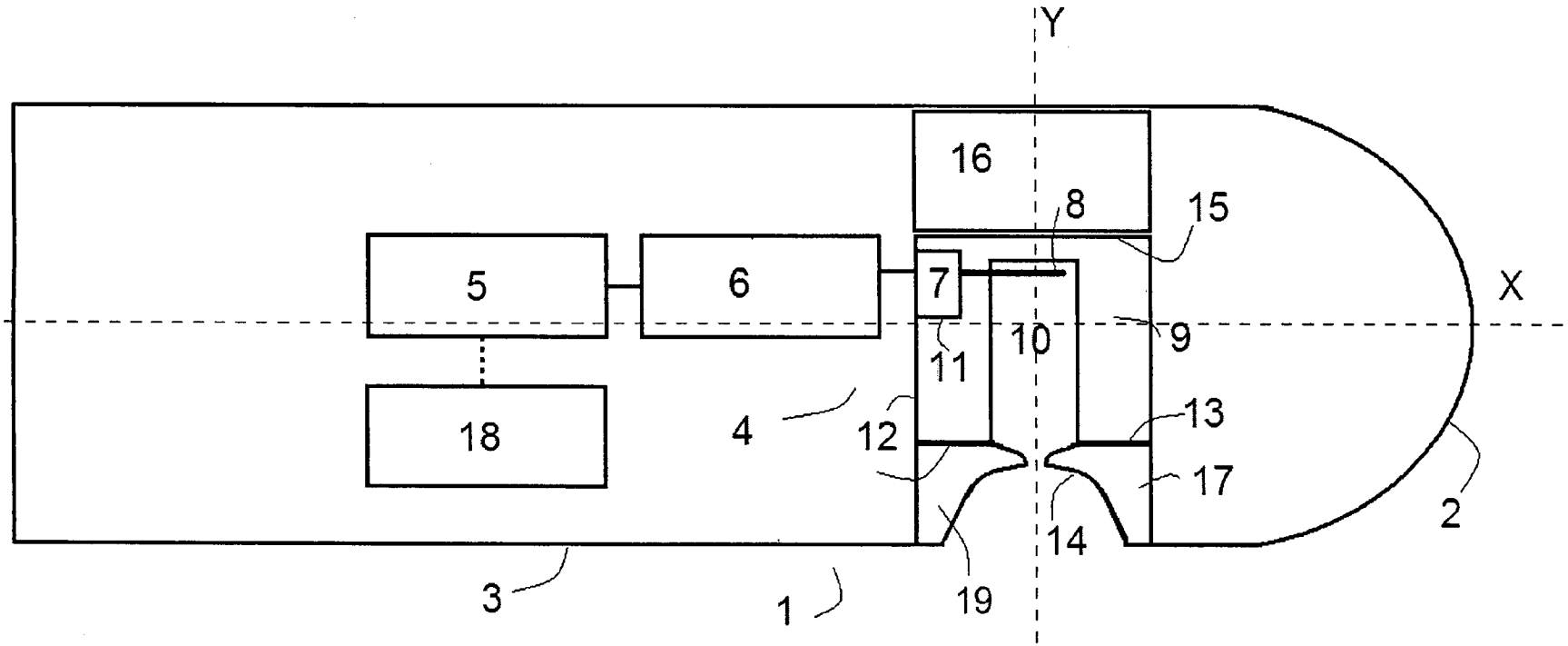

M. Comet et al., "Impressive change of reactive properties of high explosives structured and stabilized at nano-scale in an inert Porous matrix," *35th International Pyrotechnics Seminar*, For Collins, Colorado, USA, Jul. 13-18, 2008 pp. 151-158.
M. Comet et al., "Des thermites classiques aux composites interstitiels metastables," *L'actualite chimique*, No. 299, Jul. 2006.
"Nanothermite Microthruster," (http://engineering.missouri.edu/people/faculty/gangopadhyays/pages/downloads/microthruster-project-description.pdf), pp. 1-3.
S. Apperson et al., "Characterization of Nanothermite Material for Solid-Fuel Microthruster Applications," *Journal of Propulsion and Power*, vol. 25, No. 5, Sep.-Oct. 2009.
French Preliminary Search Report issued on Oct. 15, 2009 in French Patent Application No. FR 0901037.

* cited by examiner

PILOTING DEVICE OF A MISSILE OR OF A PROJECTILE

The invention concerns the field of devices for improving the piloting of projectiles. More specifically, the object of the invention is a piloting device for a missile and a missile associated therewith.

Distinction may be made between three major categories of projectile and missile piloting.

"Classic" aerodynamic piloting consists of deploying various types of piloting surfaces (fins, canard systems, various tail groups in various locations). This type of piloting, however, is known to be slow and loses efficacy at high altitudes (weak pressure on the piloting surfaces) and its application to projectiles of small dimensions is difficult.

Aerodynamic piloting by micro-actuator is now being studied in the scientific community. Various concepts are to be found, such as the GSP concept and plasma discharge. MEMS (Micro Electro Mechanical Systems) are also used in this type of piloting—for example, by placing a stud near a wing, or through the use of electromechanical micro-actuators as described in U.S. Pat. No. 6,474,593. The use of MEMS, however, is hard to envisage for the piloting of missiles.

Piloting of missiles is accomplished by burning propellant powder (various propellants, out of boosters, etc.) in order to obtain thrust power as well as forces and moments of interaction with the external flow.

It is, however, not possible to pilot projectiles with classic propellant powder, as is done in the case of missiles, because:

- the volume available for the initiator necessary for such powder and the powder itself is too limited for interception projectiles which typically have a calendar on the order of 40 mm;
- the energy is not stored densely enough and is not released quickly enough, especially for gyro-stabilized projectiles rotating at several thousand revolutions per second;
- there is a risk of detonation when the powder is too confined, so that the combustion chamber cannot be totally filled (typically, a one-third charge is the maximum);
- combustion of small quantities, less than 100 mg, of this type of powder is not reliable, in the sense that especially the speed and the direction of combustion are not reproducible for small quantities.

To resolve these disadvantages, United States Patent Application US2005/0103925 describes a guidance device for a projectile which includes a combustion chamber closed by a lid which is attached to the projectile and containing a powder which is capable of igniting and electrical means of priming that powder. The ignition of the powder produces gas, which gives rise to an increase of the pressure in the combustion chamber, until the attachment between the projectile and the lid breaks, expelling the lid.

Such a device has the disadvantage of making a gaping hole in the projectile, which is likely to modify its trajectory and thereby to necessitate the use of a cascade of other means of guidance, arranged in the form of a crown.

One of the objectives of the invention is to propose a means of piloting which can be used for both missiles and projectiles of small caliber, especially on the order of 40 mm, and which does not give rise to a long-lasting and continuous modification of the trajectory of the missile.

The solution provided is a piloting device of a missile or of a projectile, for example, one of small caliber, especially on the order of 40 mm, which has a lateral main surface with a nose at the level of one of its extremities, whereby said device includes at least one cavity consisting of a combustion chamber and filled, at least partially, by an explosive powder, and means of initiation of this explosive powder, and whereby the explosive powder contains nanothermites, these nanothermites being preferably associated with a classic fuel, such as propellants, or being of the gas-generating type.

Thermites are energetic materials composed of a metallic oxide associated with a metal reducing agent[1]. The combustion of thermites takes place according to a mechanism of transfer of oxygen from the oxide to the metal, leading to the formation of liquid or solid species. This explains the fact that, by contrast to explosives, thermites burn lively, but without detonating. Classic thermites are characterized by a high density, a high level of insensitivity to thermal and mechanical stress and relatively low combustion speeds.

It is known that the nanostructure of the reactants involved in the formulation of thermites favors the transfer of materials and totally modifies their reactivity, and it has been found that new-generation thermites, commonly known as nanothermites, can be made to combust easily, for example, through the effect of an exploding wire with a combustion speed which is quite higher than that of classic thermites and suffices to enable the direct or indirect guidance of a projectile. These nanothermites, also known as superthermites or metastable interstitial composites, R., for example, described in the article by Marc Comet and Denis Spitzer entitled "Des thermites classiques aux composites interstitiels métastables" [From classic termites to metastable interstitial composites], *L'actualité chimique*—July 2006—No. 299.

In addition, the preparation of nanothermites in powder form is implemented by simple compression and does not call for a binding material. Compressed objects are characterized by a remarkable cohesion; their apparent density can be adjusted over a very broad range by adjusting the intensity of the compression.

Gas-generating nanothermites constitute a new concept particularly suited to propulsive piloting, because they contain variable proportions of nanoparticles of explosives, enabling adjustment of the pressure produced by combustion. Gas generation enables the ejection of the liquid or solid matter formed by the combustion of the thermite and increasing the combustion speed in a semi-confined environment. The decomposition of gas-generating nanothermites in a confined environment is produced by deflagration. The transition to a destination regime cannot take place as long as the nanoparticles of explosives are distributed in a discontinuous manner in the material.

Gas-generating nanothermites can be prepared by the physical mixture of a nanocomposite material with nanoparticles of commercial aluminum (e.g.: Al 50P, Novacentrix). The physical mixture is typically implemented by simultaneous dispersion of the two products in a non-dissolving liquid phase such as hexane.

A first type of nanocomposite material can be obtained by doping the nanometric porosity of chromium (III) oxide produced by combustion, with variable proportions of explosives such as:

- hexogen, as described by M. Comet, B. Siegert, V. Pichot, P. Gibot, D. Spitzer, *Nanotechnology,* 2008, 19, 2-9,
- octogen or pentrite, as described by M. Comet, B. Siegert, V. Pichot, D. Spitzer, F. Ciszek, N. Piazzon, P. Gibot, Impressive change of reactive properties of high explosives structured and stabilized at nano-scale in an inert porous matrix, 35$^{th}$ *International Pyrotechnics Seminar,* Fort Collins, Colo., USA, Jul. 13-18, 2008, 151-158.

A second type of nanocomposite can be prepared by infiltrating the porosity of manganese (IV) dioxide with variable proportions of hexogen, as described by M. Comet, V. Pichot, D. Spitzer, B. Siegert, F. Ciszek, N. Piazzon, P. Gibot, Elaboration and characterization of manganese oxide ($MnO_2$) based "green" nanothermites, 39$^{th}$ *International Annual Conference of ICT,* Karlsruhe, Germany, Jun. 24-27, 2008, V 38-1 to V 38-8.

Thus, by comparison to classic propellants and powders and to classic thermites, gas-generating nanothermites present the following advantages:

- response times are considerably reduced, relative to classic thermites,
- combustion speeds are very high and can be adapted to the specific characteristics of each type of projectile,
- the density of nanothermites is higher than that of classic propellants and powders.

In other words, the quantity of energy stored in a small volume is greater and the ejected mass at the time of combustion is much larger.

According to a specific embodiment, a device according to the invention includes a nozzle located in the extension of said combustion chamber and, preferably, opening near the lateral main surface of the projectile or missile.

According to other embodiments of the invention, a device according to the invention includes a piston possessing a rod and a head and capable of sliding into the interior of a bore, and one of the surfaces delimiting the combustion chamber is formed by the head of the piston or by an element located facing said head, a control surface being advantageously located at the free end of the piston rod and, preferably, the device includes possibly reversible means for locking the position of the piston in the interior of said bore, which may, for example, consists of a retractable stop.

According to an additional characteristic, a device according to the invention includes two cylindrical elements respectively arranged on one side and on the other side of the piston head, whereby each of said elements includes at least one constitutive cavity, and preferably at least two constitutive cavities, of a combustion chamber, and including a cover at one of the extremities thereof, consisting, for example, of a membrane.

According to another characteristic, said means of initiation of the powder include means of command 18, and electrical power supply 5 and a platinum wire.

The invention also concerns a projectile or a missile which contains a guidance according to the invention.

Figure 2:
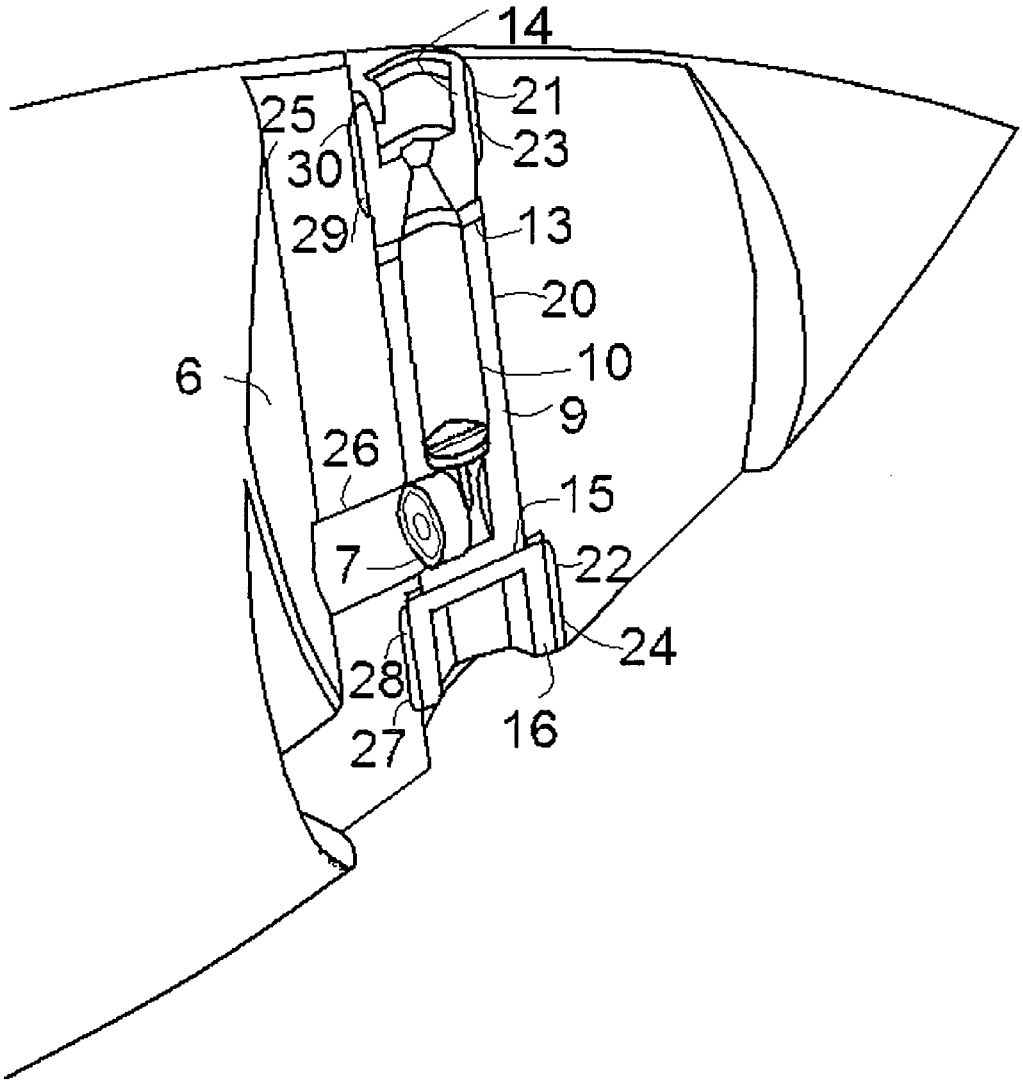
Figure 3:
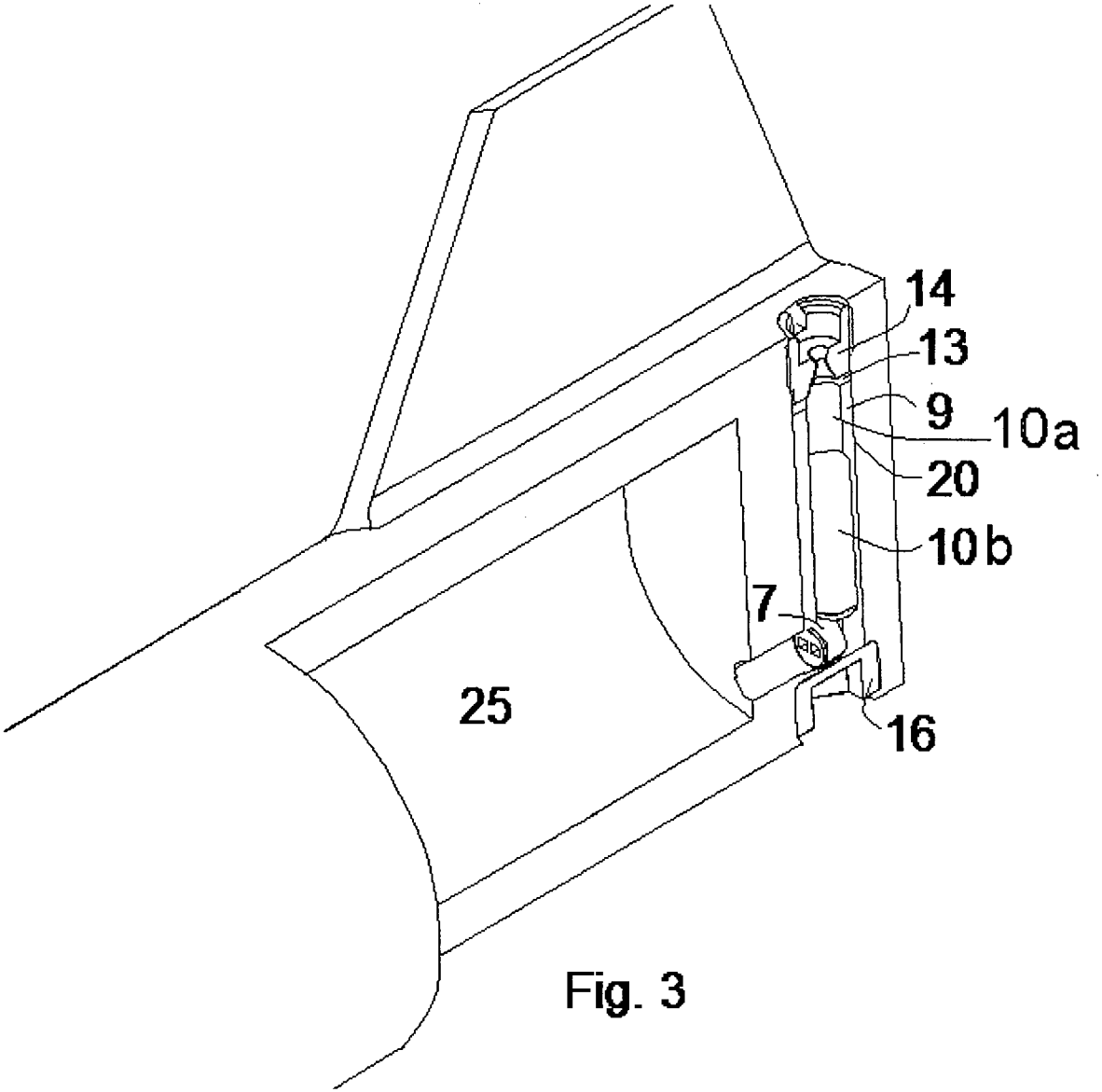

Additional advantages and characteristics will appear in the description of two embodiments of the invention relative to the attached figures, in which:

FIG. 1 shows a projectile which contains a guidance device according to a first embodiment of the invention, FIG. 2 presents a more detailed schematic diagram of part of the device according to said first embodiment of the invention, FIG. 3 shows a schematic diagram of the implantation of a guidance device according to FIG. 1 at the back of a finned projectile.

Figure 4A:
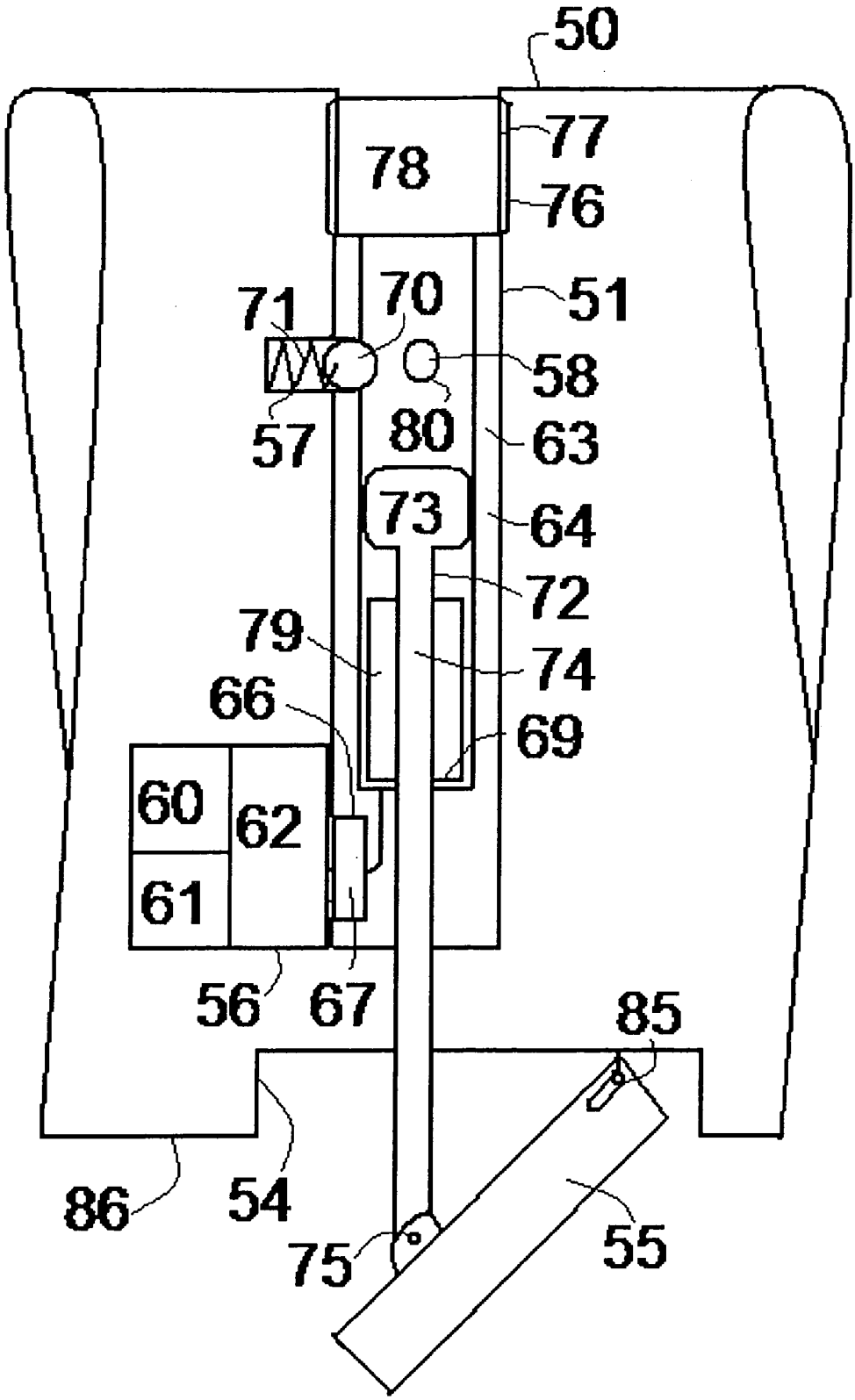
Figure 4B:
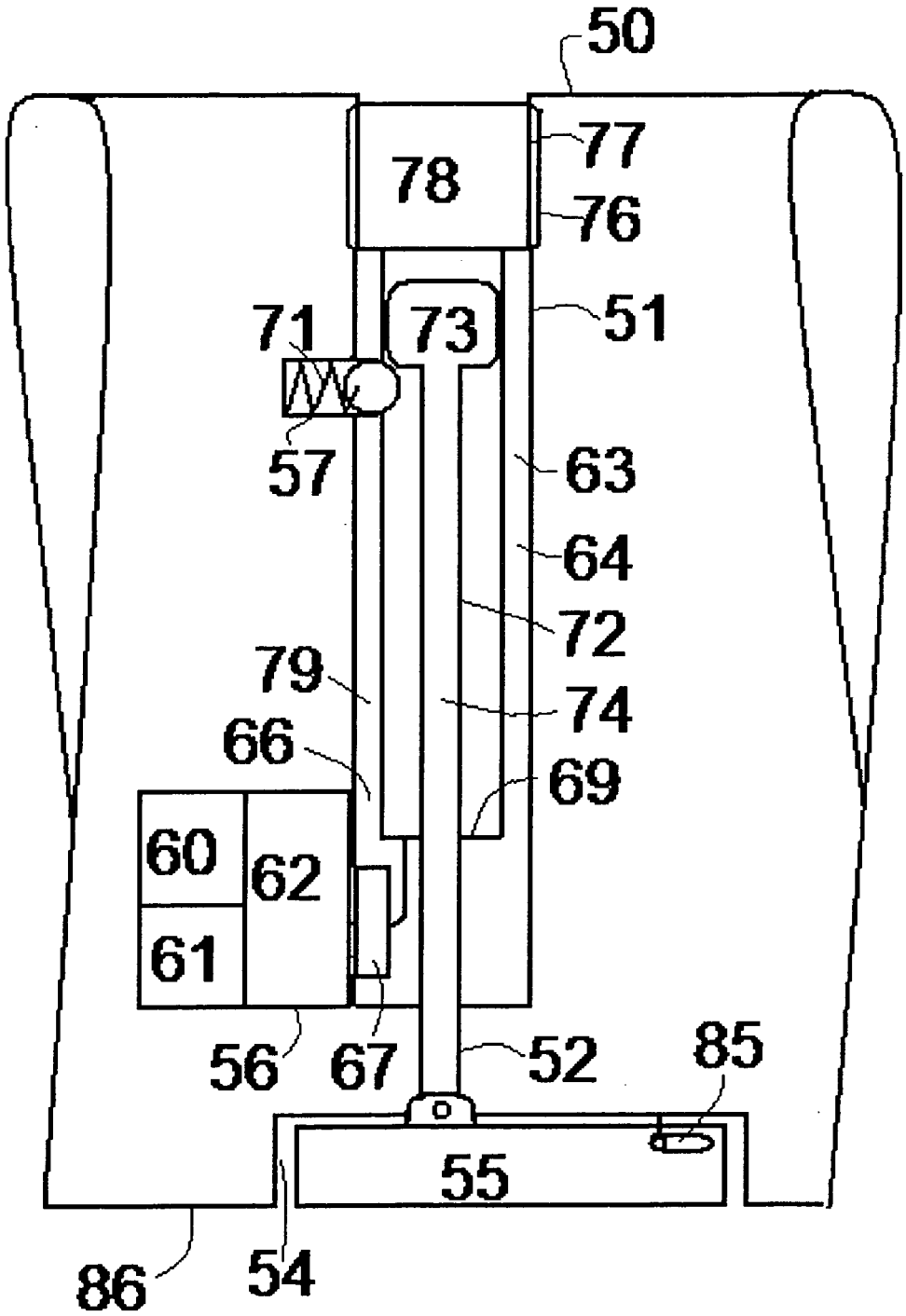
Figure 5A:
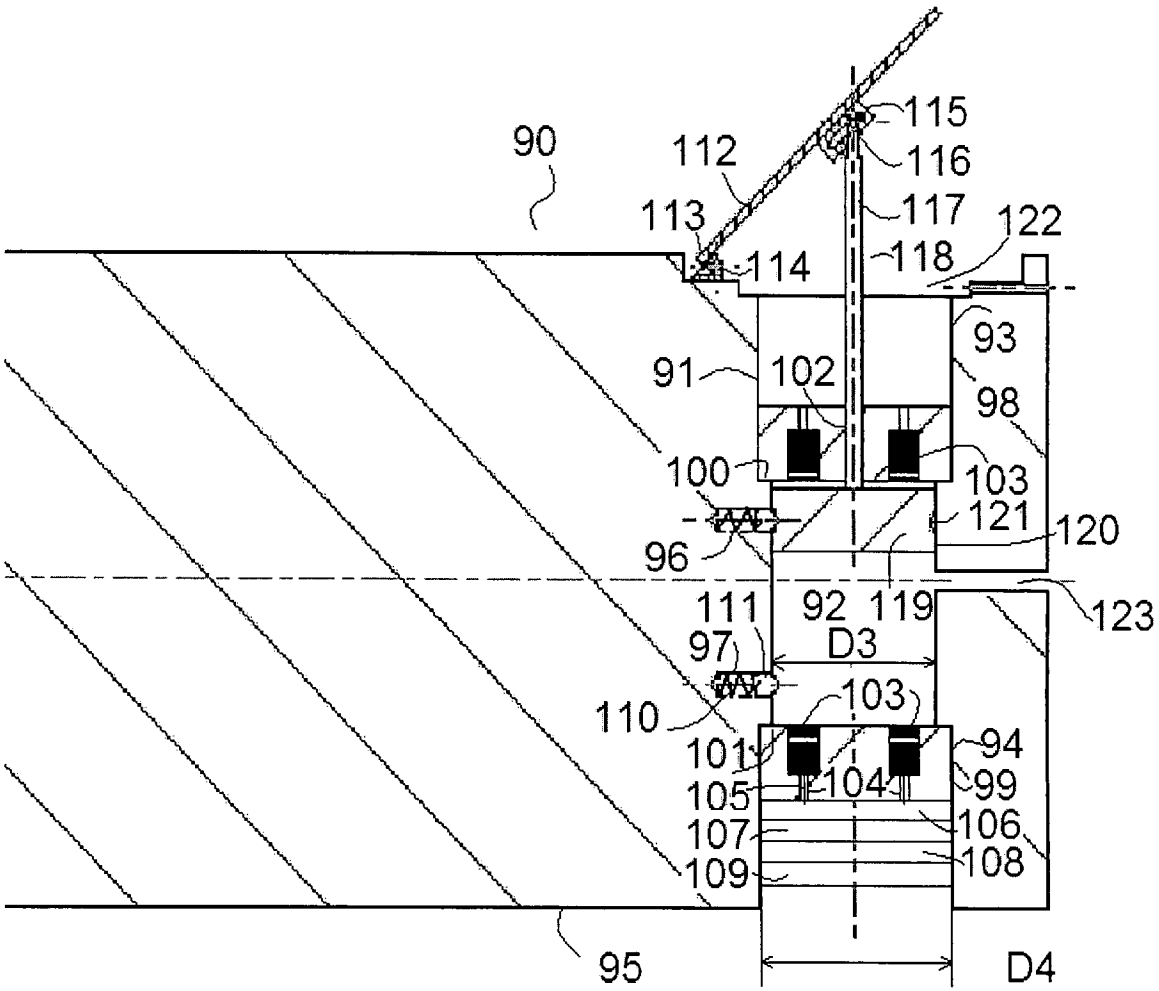
Figure 5B:
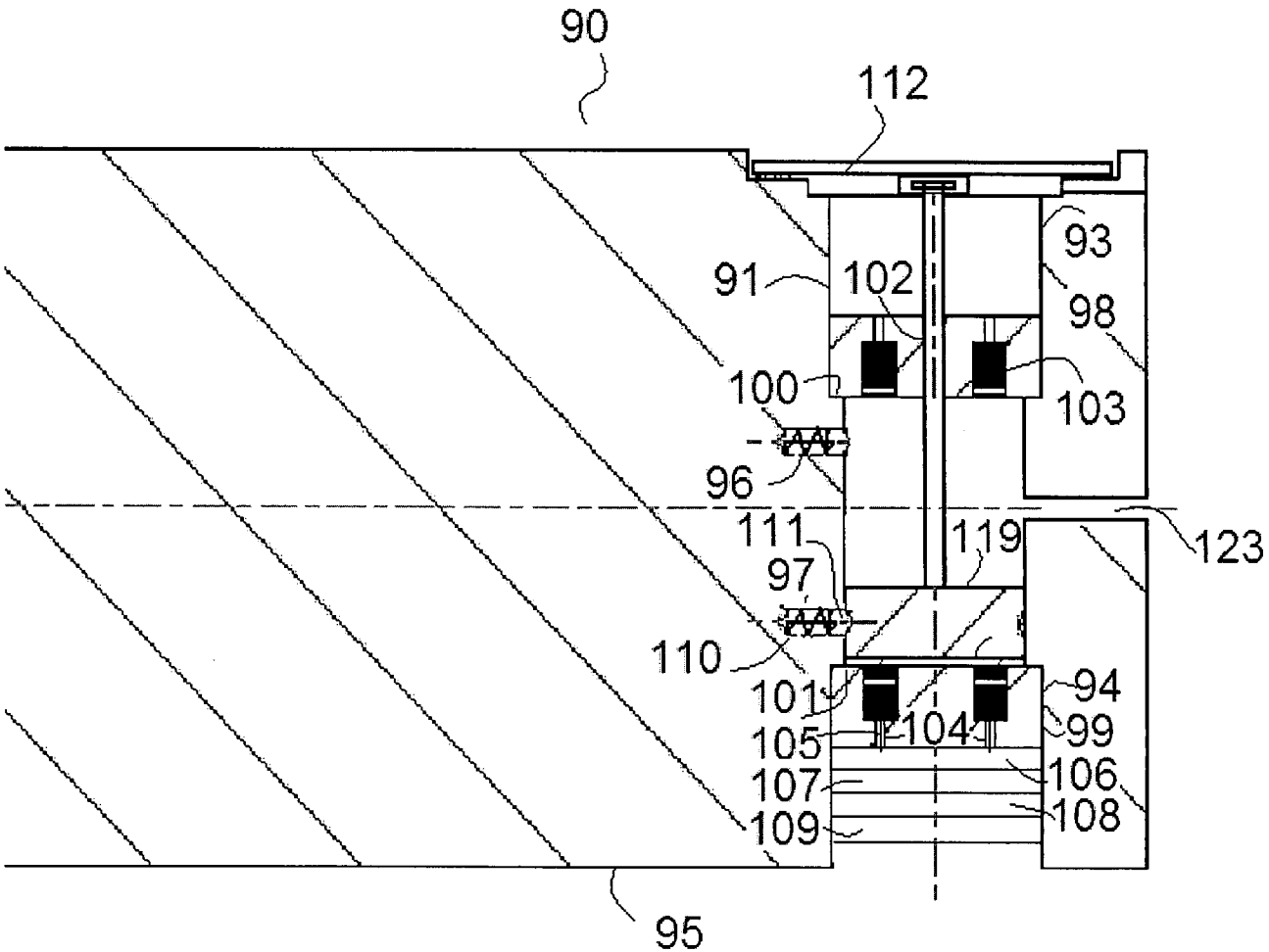

FIGS. 4*a* and 4*b* show a piloting device of a missile or of a projectile according to a second embodiment of the invention and including an exit control surface which is in active position in FIG. 4*a* and in passive position in FIG. 4*b*, FIGS. 5*a* and 5*b* show a piloting device of a missile or of a projectile according to a third embodiment of the invention and including a double-effect actuator which may be used several times.

FIG. 1 shows a general schematic diagram of a device according to a first embodiment of the invention.

FIG. 1 presents a projectile which includes a guidance device according to a first embodiment of the invention. Said projectile 1 has a cylindrical exterior with a longitudinal axis X with a lateral main surface 3, of which one of the extremities 2, specifically the front, is in the shape of a cone which forms the nose of the projectile. Located on the inside of this projectile is a guidance device of the projectile which, in this embodiment, includes:

- Means of command 18, an electrical power supply 5, means 6 of amplification of the voltage generated by the electrical power supply 5 electrically connected to a connector 7.
- A cylindrical element 9 with a rotational symmetry around axis Y and including a first longitudinal central bore 10 of axis Y opening onto one of the faces 13 of the cylindrical element 9 and a second transverse bore 11 opening onto the transverse face 12 of the cylindrical element 9, in which is placed said connector 7. These first and second bores are connected by a third bore, in which is placed a platinum wire 8 connected to said connector 7.
- A nozzle 14 with a rotational symmetry around axis Y which includes a cylindrical jacket 17 with an external diameter basically equal to that of the cylindrical element 9, is positioned against the latter in such a way as to extend the first bore 10 and in such a way that the axis of the first bore and the axis of the nozzle are collinear. A joint, not shown, is located between the cylindrical element 9 and the nozzle 14. The external surface 19 of the nozzle is flush with the lateral surface 3 of the projectile 1,
- A cylindrical stopper 16 with an external diameter basically equal to that of the cylindrical element 9 is interposed between the transverse 15 of the latter and the lateral wall 3 of the projectile.

The cavity 10*a* formed by the first bore 10 and the nozzle 14 constitute a combustion chamber. At the time of the implementation of the guidance device, said combustion chamber is filled, in whole or in part, by powder 10*b* containing nanothermites, as a function of the desired deviation of the trajectory.

The means of command 18, the electrical power supply 5 and the platinum wire 8 constitute means of initiation of said powder containing nanothermites.

This guidance device is accordingly a thruster.

The percentage of nanothermites dispersed in the powder inserted into the combustion chamber, the nature of these nanothermites, their confinement ratio, their compression ratio and the dimensions of the gas ejector nozzle are selected as a function of the initiation delay, the duration of the action and the intensity of the action desired.

The gas-generating nanothermite is placed in a micro-combustion chamber, the size of which, relative to the nanothermite (filling ratio), corresponds to the selected confinement. Its value may be close to 1.

Located at the top of the micro-thruster is the nozzle by which the cast is ejected.

The nozzle may be a simple tapered pipe, a tapered nozzle or a profiled nozzle.

The platinum wire is connected to the connector, which ensures water tightness between the combustion chamber and the means of amplification.

The electrical power supply in this case is constituted by two batteries of the LiPo type on board the projectile.

The micro-thruster may be located in any appropriate location between the front and the rear of the projectile, and a plurality of thrusters may be onboard.

FIG. 2 presents a more detailed schematic diagram of a cutaway view of the assembly formed by the stopper 16, the cylindrical element 9, the nozzle 14 and the arrangement thereof within the projectile.

Said projectile includes:

a first radial bore 20 having a first and a second tapping 21, 22 at each of its respective extremities 23, 24, a second axial bore 25 with axis X, the first and second bores being connected by a third bore 26 with a longitudinal axis parallel to the axis X.

The stopper 16 includes a threading 27 on its lateral surface 28 which is capable of cooperating with the tapping 22 in such a way as to enable it to be solidly attached to the projectile. Similarly, the nozzle 14 includes a threading 29 on its lateral surface 30 which is capable of cooperating with the tapping 21 in such a way as to enable it to be solidly attached to the projectile. The cylindrical element 9 is inserted between the stopper 16 and the nozzle 14 in such a way that the connector placed in said second transverse bore 11 of the element 9 is located facing the third bore 26 of the projectile, thus enabling connection of the amplifier 6 to the connector 7. In this way, the cylindrical element is held in position by the projectile at the level of its lateral surface 12 and respectively by the stopper and by the nozzle via its respective transverse surfaces 15 and 13.

The operation of this guidance device is as follows:

Upon receipt of a signal originating, for example, in a weapons system associated with the projectile, the means of command 18 command a generation, by the electrical power supply 5, of a potential difference which is then amplified by the means 6 of amplification and applied in the extremities of the platinum wire 8 via the connector 7.

This potential difference gives rise to a heating of the platinum wire which, in turn, causes the explosion of the nanothermite powder. This explosion is produced within a very short time and generates, in near-real-time, gases which escape from the guidance device at great speed via the nozzle 14.

The escape of these gases from the projectile in an extremely short time produces a variation of the projectile trajectory in a direction opposite to that of the gas escape. This variation in direction is a function of the flow rate of the gas release, and thus especially of the percentage of nanothermites dispersed in the powder inserted into the combustion chamber, the nature of these nanothermites, their confinement ratio, their compression ratio and the dimensions of the gas ejector nozzle 14.

FIG. 3 shows part of the guidance device according to this first embodiment of the invention but located at the level of a back fin of a projectile. The means of command, power supply and amplification are not shown in order to improve the clarity of the figure.

In this embodiment, the operation is the same as that described in FIGS. 1 and 2 and is similar to that of a stud.

FIGS. 4*a* and 4*b* show a piloting device of a missile or of a projectile according to a second embodiment of the invention, which includes an exit control surface which is in active position in FIG. 4*a* and in passive position in FIG. 4*b*.

Only part 50 of the projectile is shown. This part 50 of the projectile includes a first half-opening radial bore 51 and a second collinear radial bore 52, with a diameter smaller than that of the first, which connects the bottom 53 of the first bore to a groove 54 made in the peripheral surface of the projectile and intended to hold a control surface 55 solidly attached to the projectile by means of a mobile link 85.

This part 50 of the projectile also includes a first axial bore 56 located at the level of the bottom 53 of the first radial bore 51 and a second axial bore 57 opening into the upper part of the first bore 51. An escape conduit 58 located in the vicinity of the second axial bore 57 connects the first radial bore to the peripheral surface 86 of the projectile.

Means of command 60, an electrical power supply 61 and means 62 of amplification of the voltage generated by the electrical power supply are inserted into the first axial bore 56. A cylindrical element 63 with a length shorter than that of the first radial bore 51 and of essentially the same diameter, is inserted into the latter. It includes a first part consisting of a bore 64 with internal diameter D1, which forms a first tubular part, followed by a second tubular part 65 with internal diameter D2 equal to that of the second radial bore 52, whereby one of the extremities of this second part rests on the bottom 53 of the first radial bore 51. This cylindrical element 63 also includes a transverse bore 66 at the level of its second tubular part 65 and located facing the first axial bore 56. A connector 67, located in the transverse bore 66, is electrically connected, on one hand, to the means 62 of amplification and, on the other hand, to a platinum wire 68, part of which rests on the bottom 69 of the first tubular part 64.

A stop 70, which is solidly attached to an electrical actuator 71 commanded by the means of command 60 and receiving power from the power supply 61, is located in the second axial bore 57.

This cylindrical element 63 includes a bore 80 located facing the escape conduit 58. A piston 72 includes a head 73 with a diameter essentially equal to the internal diameter D1 of the first bore of the cylindrical element 63 and a rod 74 with a diameter essentially equal to diameter D2. The head 73 is located inside the first tubular part 64 of the cylindrical element 63, while the rod 74 is partially inside this first part 64, partially inside the second tubular part 65 and partially inside the second radial bore 52. Its free end is solidly attached to a joint 75 attached to the control surface 55.

The upper part 76 of the first radial bore 51 includes a tapping 77, and a metallic stopper 78, which includes a threading which is capable of cooperating with said tapping, is located on the cylindrical piece 63 in such a way as to stop the corresponding extremity of said first tubular part 64.

The cavity 81 delimited by the interior of the cylindrical piece 63, the head 73 of the piston 72, the bottom 69 of the first tubular part 64 said cylindrical piece 63 is partially filled with powder 79 which, at least partially, contains nanothermites, and constitutes a combustion chamber. The means of command 60, the electrical power supply 61 and the platinum wire 68 constitute means of initiation of said powder containing nanothermites.

The operation of this device is as follows:

When the projectile is fired, the control surface 55 is in passive position, retracted inside the groove 54 made in the surface of the projectile, as shown in FIG. 4*b*, and the stop 70 is inside the second axial bore 57.

The firing gives rise to a gyration of the projectile, whereby said gyration is sufficient, as a result of the centrifugal force exerted on the piston 72, to deploy the control surface 55 outside the groove 54 as shown in FIG. 4*a*.

To vary the trajectory of the projectile, the means of command 60, using, for example, an external command signal, command the electrical power supply 61 to generate a potential difference which is subsequently amplified by the means of amplification 62 and applied to the extremities of the platinum wire 68 via the connector 67.

This potential difference gives rise to a heating of the platinum wire which, in turn, causes the explosion of the nanothermite powder 79. This explosion is produced within a very short time and generates, in near-real-time, gases which exert pressure on the head of the piston, which moves almost instantaneously in the direction of the stopper 78 in order to attain the position shown in FIG. 4*b*. The gases generated then escape by the escape conduit, while the means of command 60 command the deployment of the actuator 71 and thus the movement of the stop 70 out of the second axial bore 57, whereby part of said stop 70 is then located inside the first tubular part 64 of the cylindrical element 63. In this way, this stop 70 prevents the control surface 55 from coming out again, by means of the centrifugal force due to the gyration of the projectile, until another command signal commands the retraction of the actuator 71.

This device thus acts like a single-effect actuator and only operates once.

FIGS. 5*a* and 5*b* show a piloting device of a missile or of a projectile according to a third embodiment of the invention and including a double-effect actuator which may be used several times.

These figures show the back part 90 of a projectile which includes a radial bore 91 with a diameter D3 in its intermediate part 92 and a greater diameter D4 at the level of its second and third parts 93 and 94, which are located respectively on one side and on the other side of the median part 92, and each of which opens at the level of the lateral surface 95 of the projectile. The difference in diameter between the intermediate part 92 and the second and third parts 93 and 94 forms shoulders which are respectively referenced as 100 and 101.

The intermediate part 92 includes two axial bores 96 and 97 respectively located in the vicinity of said second and third parts 93 and 94. It also includes an axial conduit 123 for evacuation of the gases.

A stop 111 associated with a spring 110 is located inside each of the two axial bores 96 and 97, in such a way that only one spherical-shaped part of the stop 111 extends into the inside of the intermediate part 92. Two cylindrical elements 98 and 99 with a diameter essentially equal to D4 are respectively located against the shoulders 100 and 101, in such a way that their axis of symmetry and that of the radial bore 91 are coaxial.

One of these cylindrical elements includes an axial bore 102, while each of them includes at least one cavity 103 which opens at the level of said intermediate part 92 and is connected to the part in which the cylindrical element in question is located, by a channel with a small diameter 104.

Associated with each of these cavities is a platinum wire 105, which rests in part on the bottom of the cavity and is connected, via said canal 104, to a connector 106 which is itself connected to means of voltage amplification 107, means of electrical power supply 108 and means of command 109. For the sake of clarity of the figure, these latter elements are only shown as being associated with the cavities of the cylindrical element 99; however the same assembly or a similar assembly is also associated with the cylindrical element 98.

In addition, these cavities 103 are filled, in whole or in part, by compacted powder, at least one of which contains nanothermites, and these cavities are covered by a membrane 130 which is capable of keeping the powder in position before use. Each of these cavities 103 constitutes a combustion chamber.

A control surface 112 is associated with the elements described above. One of its extremities 113 is solidly attached to the projectile via a mobile link 114, and it includes a joint 115 in its intermediate part, whereby this articulation is connected to one extremity 116 of the rod 117 of a piston 118. The head 119 of the piston 118 is located inside said intermediate part 92 and can slide inside the latter. Said head 119 includes, in the median part of its peripheral surface 120, a hemispherical groove 121 with a diameter slightly larger than that of the emerging extremity of the stop and capable of cooperating with it in order to keep the piston in a stable position.

The rod 117 of the piston 118 has a diameter essentially equal to that of the axial bore 102 in one of the cylindrical elements and can slide inside said bore 102.

In this way, the piston can take two stable positions, in which it is held by a stop:

- the first position, in which the head of the piston is against the cylindrical element 98 which comprises the axial bore 102 and in which, as shown in FIG. 5*a*, the control surface is active and extends beyond the peripheral surface of the projectile
- the second, in which the head of the piston is against the other cylindrical element 99 and in which, as shown in FIG. 5*b*, the control surface is passive and is located within a groove 122 made on the surface of the projectile. In this way, it does not extend beyond the peripheral surface of the projectile.

The means of command 108, the electrical power supply 109 and the platinum wire 105 constitute means of initiation of said powder containing nanothermites. The operation of this device is as follows:

When the projectile is fired, the control surface 112 is in passive position, retracted inside the groove 122 made in the surface of the projectile, as shown in FIG. 5*b*. The firing gives rise to a gyration of the projectile, whereby said gyration exerts a force on the piston which is weaker than that of the stop on the head 119 of the piston 118. As a result, after firing, the control surface remains in passive position.

To vary the trajectory of the projectile, the means of command 109, using, for example, an external command signal, command the electrical power supply 108 to generate a potential difference which is subsequently amplified by the means of amplification 107 and applied, via the connector 106, to the extremities of one of the platinum wires 105 partially located in one of the cavities 103 of the cylindrical element 99.

This potential difference gives rise to a heating of the platinum wire 105 which, in turn, causes the explosion of the nanothermite powder. This explosion is produced within a very short time and generates, in near-real-time, gases which caused the explosion of said membrane and exert a force on the head 119 of the piston 118 which is greater than that of the stop 111; the head of the piston then moves almost instantaneously in the direction of the other cylindrical element 98 until it is pushed up against it. The control surface 112 is an essentially in the position shown in FIG. 5*a*. As the combustion gases escape by means of the evacuation conduit 123, the pressure exerted on the head of the piston diminishes. At the same time, the hydrodynamic pressure exerted on the control surface tends to push the piston in the direction of the cylindrical element 99. However, when it goes back, the stop 111 enters the hemispherical groove of the head of the piston and keeps it from moving. It is thus possible to command the return of the control surface to its passive position by commanding the explosion of the nanothermite powder located in one of the cavities 103 of the cylindrical element 98—specifically, in the cavity which is closer to the head of the piston. As a function of the number of cavities, it is possible to maneuver the control surface several times, making it move from an active position to a passive position and vice versa.

The invention claimed is:

1. A missile or projectile of a small caliber having a piloting device, the missile or the projectile comprising:

- a longitudinal axis and a lateral main surface having extremities and a nose, the nose located at a level of one of the extremities, wherein:

the missile or projectile having a radial bore with an axis perpendicular to the longitudinal axis and opening on the lateral main surface, and the piloting device including:

a cylindrical element having at least one cavity consisting of a combustion chamber and filled, at least partially, by an explosive powder including nanothermites, the cylindrical element and the combustion chamber being placed inside the radial bore and according to its axis, and means for initiating the explosive powder.

2. The missile or projectile according to claim 1, further comprising:

a piston having a rod and a head, the piston sliding inside a bore, a surface delimiting the combustion chamber is formed by the head of the piston or by an element located facing the head of the piston.

3. The missile or projectile according to claim 2, further comprising:

a control surface located at a free end of the rod of the piston.

4. The missile or projectile according to claim 2, further comprising:

two cylindrical elements respectively arranged on one side and on an other side of the piston head, wherein each of the two cylindrical elements includes at least one constitutive cavity of the combustion chamber, and including a cover at one of the extremities thereof, the cover including a membrane.

5. The missile or projectile according to claim 2, further comprising:

means for locking a position of the piston inside the bore.

6. The missile or projectile according to claim 5, wherein the means for locking is reversible.

7. The missile or projectile according to claim 6, wherein the means for locking includes a retractable stop.

8. The missile or projectile according to claim 1, wherein the means for initiating the explosive powder includes means for command, an electrical power supply and a platinum wire.

9. The missile or projectile according to claim 1, wherein the small caliber of the piloting device is configured for a projectile or missile that is on an order of 40 mm.

10. The missile or projectile according to claim 1, wherein the combustion chamber is linked to outside the missile or the projectile by said radial bore.

11. The missile or projectile according to claim 10, further comprising a nozzle located radially in said radial bore and in an extension of the combustion chamber.

* * * * *